United States Patent [19]

Northup

[11] 3,966,071

[45] June 29, 1976

[54] VENTING BOTTLE CLOSURE

[76] Inventor: John D. Northup, 2460 Underhill Road, Toledo, Ohio 43615

[22] Filed: May 1, 1975

[21] Appl. No.: 573,745

[52] U.S. Cl. ..... 215/260; 215/307

[51] Int. Cl.[2] ..... B65D 51/16

[58] Field of Search ..... 215/260, 262, 270, 307, 215/348, 271; 220/231, 240, 303, 366, 367, 373, 374

[56] References Cited

UNITED STATES PATENTS

| | | | |
|---|---|---|---|
| 1,575,464 | 3/1926 | Tamura | 215/260 |
| 2,389,761 | 11/1945 | Burgeni | 215/348 |
| 2,428,782 | 10/1947 | Browne | 215/262 X |
| 2,446,226 | 8/1948 | Glocker | 215/262 |
| 2,726,002 | 12/1955 | Dalianis | 215/260 |
| 3,114,467 | 12/1963 | Montgomery | 215/260 |
| 3,303,955 | 2/1967 | Osborne | 215/252 |
| 3,349,975 | 10/1967 | Damron | 215/348 X |

*Primary Examiner*—Donald F. Norton
*Attorney, Agent, or Firm*—Allen Owen

[57] ABSTRACT

A pressure relieving bottle closure is disclosed. The closure is of thin metal construction having an internal sealing disc and adapted to be received by a preferably screw threaded bottle neck to form top and side seals with finish surfaces of the bottle. The sealing material comprises a resilient liner within the closure. In the area of the side skirt of the metal portion of the closure which forms the area disposed over the side seal is at least one opening. If excessive pressure develops inside the bottle, pressurized fluid first escapes through the top seal of the bottle and, upon reaching the area of the side seal over which the said opening is located, pushes the sealing liner outwardly into the opening to escape through the side seal to the exterior of the bottle. The closure again seals when the excess pressure has been relieved, provided that the sealing material used possesses sufficient resiliency.

5 Claims, 4 Drawing Figures

VENTING BOTTLE CLOSURE

BACKGROUND OF THE INVENTION

The invention relates to bottle closures, and more particularly to bottle closures designed to relieve excess internal bottle pressure.

The type of closure to which this invention relates is shown in Osborne et al U.S. Pat No. 3,303,955. Such a closure preferably employs screw threads to engage the neck of a bottle and utilizes both top and side sealing areas to withstand internal bottle pressures in excess of 240 p.s.i. The top seal is formed along a flat annular horizontal finish at the top of the bottle, and the side seal is formed along a usually vertical cylindrical finish of the bottle just below and outside the top finish. A disc or ring-shaped resilient sealing liner is engaged between the top of the closure and top finish of the bottle and between the cylindrical side skirt of the closure and the side finish of the bottle to form the top and side sealing areas. The closure is formed in situ on the bottle from a generally cylindrical cap blank having no threads and including a resilient sealing liner disc or ring positioned therein. A capping machine forces the cap blank downwardly on the bottle, bending a peripheral portion of what was originally the top panel of the cap blank downwardly to form a cylindrical portion of the side skirt, somewhat smaller in diameter than the remainder of the skirt. After this operation, which forms the top and side seals of the bottle closure, has taken place, a thread roller deforms the lower portions of the skirt of the cap blank into conformity with the threads of the bottle.

Although such a bottle closure includes both top and side sealing areas, it is the side seal which is stronger and enables the closure to withstand more than 240 p.s.i. internal bottle pressure. Under high pressures, the top panel of the closure is able to bulge upwardly to a degree sufficient to allow pressurized gas to pass into the top sealing area. However, the cylindrical side seal is more difficult to push outwardly sufficiently to allow the escape of gas therethrough.

In a high pressure vessel such as a sealed bottle containing a carbonated beverage, there is a need for some means of relieving excess pressure which may develop under extreme conditions. For example, in the shipping and storage of bottles of carbonated beverages high temperatures are often encountered. These temperatures are sometimes sufficient to raise the pressure within the bottle high enough to cause failure of a glass bottle. Such bottle failure pressure is generally well below the maximum pressure capability of the closure.

U.S. Pat. No. 2,032,931 shows a venting bottle closure having arcuate relieved portions extending downward from its top surface for engaging a resilient sealing liner between the relieved portions and the top bottle finish. Between adjacent relieved portions of the closure are areas which are not relieved, permitting the sealing liner to arc upwardly in those areas under internal gas pressure to allow a portion of the gas to escape. The bottle and closure shown in this patent do not employ a side seal. U.S. Pat. No. 2,138,376 shows another venting bottle closure of the top seal type similar to that of the above patent, but requiring a modified bottle finish for permitting high pressure gas to escape. U.S. Pat. No. 3,713,545 shows a closure of the top and side seal type including pressure relieving means. The relief feature of this closure relies upon a rupturable score line in the top panel of the closure, which ruptures under high pressure to open a slit and allow the resilient liner to balloon outwardly. This is stated to draw liner material away from the side and top sealing surfaces, thereby allowing gases to pass through the seals.

Additional venting closures are shown in U.S. Pat. Nos. 2,789,719 and 3,005,455.

Prior art venting bottle closures do not provide an effective side seal release for relieving excess gas pressure above a safe, relatively low predetermined magnitude which may be, for example, between about 80 and 150 p.s.i. In particular, an effective side seal relieving closure has not been provided on the type of container closure shown in Osborne et al Patent No. 3,303,955 discussed above. In addition, many previous venting closures have not been resealable after a venting has occurred.

SUMMARY OF THE INVENTION

The present invention provides an effective pressure relieving means for the type of closure shown in Osborne et al U.S. Pat. No. 3,303,955. The closure of the present invention includes, in the sealing portion of the side skirt, at least one opening which exposes the compressed sealing liner to the exterior of the closure in that area. The opening is sized to permit excessively pressurized gas, which has already permeated the top seal, to bulge the sealing liner outwardly into the opening to thereby permit the gas or fluid to pass through the side seal between the sealing liner and the side finish of the bottle at the location of the opening. The relieved fluid then escapes between the closure threads and the bottle threads. The precise size and total number of the vent openings is determined according to the desired level of pressure at which relief should occur. Generally, the relief pressure level may be controlled by variation of the length of the opening along the circumference of the closure.

Under high internal pressures in a bottle including the relieving closure of the present invention, the top panel of the closure bulges upwardly to a degree sufficient to allow the pressurized fluid in the container to pass through the top seal. This occurs at pressures lower than those normally required to disrupt the side seal of the closure. However, in the area or areas where the above described opening in the sealing portion of the side skirt is located, pressurized fluid is allowed to escape as described above. Therefore, an effective pressure relieving means is provided which is capable of being closely controlled in respect to the level of pressure at which venting occurs. Control is achieved through the variation of the size and location of the opening or openings provided in the sealing portion of the skirt of the closure. In addition, the closure of the invention may be made to reseal after venting by the use of a highly resilient sealing liner which exerts the required sealing pressure on the bottle's side finish following venting, thereby preventing continued fluid leakage at lower pressures.

DESCRIPTION OF THE PREFERRED EMBODIMENT

Figure 1:
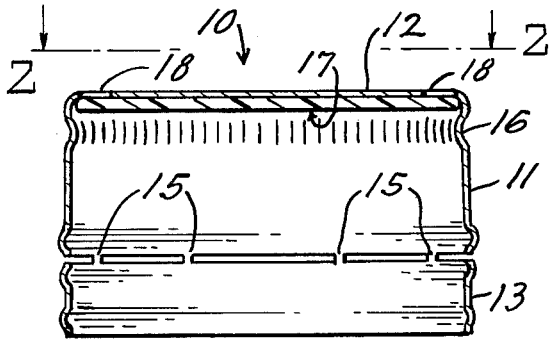
FIG. 1 is a central vertical sectional view of a relieving bottle closure blank according to the invention.

In the drawings, FIG. 1 shows in elevational section a bottle closure blank designated generally at 10. The blank 10 has a generally cylindrical side skirt 11 and a top panel 12 which is essentially flat. The skirt 11 includes a band 13 connected to the remainder of the skirt by a number of frangible bridges 15, and a knurled portion 16 which extends circumferentially around the skirt near the top. Within the closure blank is a resilient liner 17 which is preferably adhered to the underside of the top panel 12 to retain it in proper position.

Figure 2:
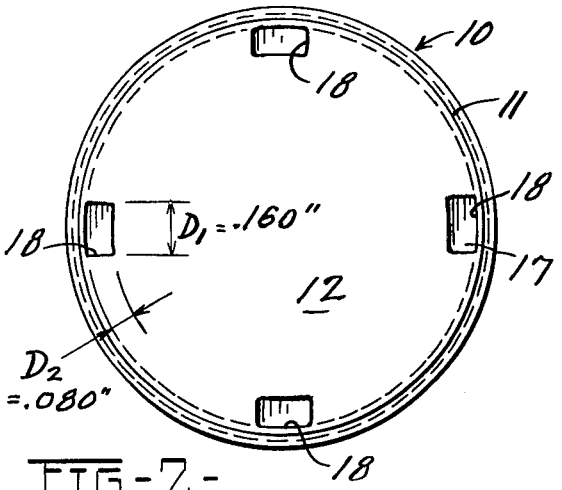
FIG. 2 is a top plan view of the closure blank taken along the line 2—2 of FIG. 1.

As shown in FIGS. 1 and 2, the top panel 12, as it exists in the closure blank 10, includes openings 18 positioned closely adjacent to the outer peripheral edge of the top panel 12. The openings 18 expose the liner 17 to the exterior of the closure 10. For reasons which will be understood with reference to tests discussed below, the openings 18 are generally rectangular with a long arcuate dimension of preferably about 0.16 inch and a short radial dimension of preferably about 0.08 inch. A slight radius of curvature at the corners of the openings 18 helps prevent weaknesses from developing in these locations of the relatively thin closure blank 10. Although four openings 18 are shown in FIG. 2, more openings or as few as a single opening 18 may be provided.

Figure 3:
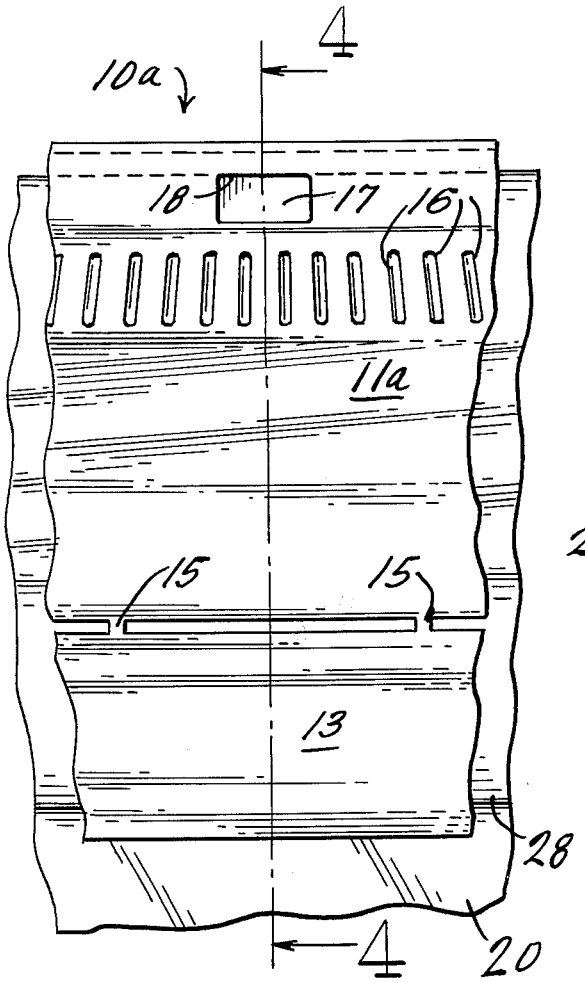
FIG. 3 is an enlarged elevational view of a portion of the closure shown assembled onto a bottle.

FIG. 3 shows a portion of a bottle closure 10*a* which has been assembled onto a bottle 20. The closure 10*a* is formed from the closure blank 10 shown in FIGS. 1 and 2. The skirt 11*a* of the closure 10*a* now encompasses the area including the openings 18 which were located in the top panel 12 of the closure blank 10. The top panel 12*a* is now smaller in diameter, as best seen in FIG. 4.

Figure 4:
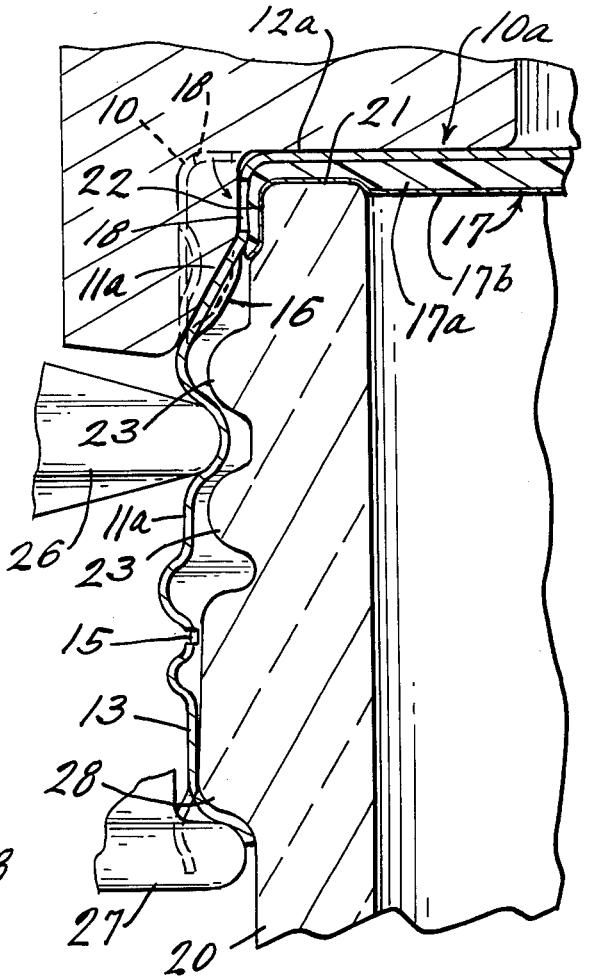
FIG. 4 is a sectional view taken along the line 4—4 of FIG. 3, indicating the manner in which the closure is assembled onto the bottle.

FIG. 4 indicates the manner in which the closure blank 10 is assembled onto the bottle 20 to form the finished closure 10*a*. With the closure 10 loosely positioned on the top of the bottle 20, which includes a top finish 21, a side finish 22 and threads 23, a pressure block 24 is lowered over the closure blank 10 to press and deform it over the top and side finishes 21 and 22 of the bottle 20 as indicated in FIG. 4. As this occurs, the openings 18, formerly in the top panel 12 of the closure blank 10, are moved downwardly into a generally vertical position adjacent the side finish 22 of the bottle. The pressure block 24 applies downward pressure, and the resilient liner 17 is compressively engaged between the top panel 12*a* and the top bottle finish 21 and between the upper portion of the closure's skirt 11*a* and the side finish 22 of the bottle. The knurled portion 16 helps prevent bending in that area during this operation. After the cap has been deformed into its engaged position along the two finish surfaces 21 and 22 of the bottle 20, a thread roller 26 deforms the skirt 11*a* into conformity with the bottle's threads 23. At the same time, a lower roller 27 turns the bottom of the band 13 under a shoulder 28 of the bottle. These skirt and band deforming operations hold the closure 10*a* down on the bottle 20 to retain the liner compression and sealing efficiency. The entire closure seating and deforming operation is conventional and is described in Osborne et al U.S. Pat. No. 3,303,955.

However, the closure of the above patent employs a liner of a unitary construction, for which polyvinyl chloride is the suggested material. Although such a construction is satisfactory for use with the present venting closure, and venting occurs reliably under excess pressures, it generally cannot be relied upon to reseal after venting to prevent further fluid leakage at lower pressures. Therefore, the liner 17 of the present closure is preferably of a highly resilient material—more resilient than, say, polyvinyl chloride. Accordingly, the liner 17 may be of a composite, laminated construction, with a highly resilient outer portion 17*a* and a suitable facing layer 17*b*. The highly resilient portion 17*a* is preferably of latex or plastic foam, while the thin facing layer 17*b* might be aluminum foil or a film of polyethylene, polyvinyl chloride, polypropylene, saran or polyvinylidene chloride. Such a construction enables the closure 10*a* to reseal after venting.

With the openings 18 now extending nearly throughout the vertical height of the bottle's side finish 22, the sealing liner 17 is afforded locations at which it can bulge outwardly under excessive gas pressure as discussed above. The openings 18 should vertically extend through at least most of the height (preferably at least 80%) of the side finish 22 of the bottle.

Tests were conducted utilizing bottle closures as discussed above. In the tests, four openings were provided in the closure blanks at 90° spacing around the periphery of the closure blanks, as shown in FIG. 2. The dimensions of the openings in the blanks were approximately 0.080 inch width (radial dimension) and 0.160 length (circumferential dimension). Thus, the openings had a length of about 0.05 times the circumference of the side skirt of the blank.

The tests were conducted utilizing one-way Pepsi-Cola bottles of 16-ounce capacity, filled to a point approximately two inches below the top with a sulfuric acid solution (15.3 ml. of concentrated $H_2SO_4$ per gallon). Into each bottle were placed 11 ten-gram tablets of Lilly sodium bicarbonate, each bottle being immediately capped thereafter utilizing the procedure illustrated in FIG. 4 above. By this test method, four gas volumes of carbon dioxide are produced in each bottle.

The four capped bottles were then placed in an evenly temperature controlled water bath in order to bring the contents of the bottles to predetermined test temperature levels from which the internal pressures of the bottles could be calculated. The relation of gas volumes of carbon dioxide in water to temperature and pressure has been calculated from values at zero gauge pressure by Bohr and Beck in Landolt-Bornstein's Physikalische-Chemische Tabellen. The values given therein for 4.0 gas volumes are as follows:

| | |
|---|---|
| 100°F | 91.0 p.s.i. |
| 110°F | 103.3 p.s.i. |
| 120°F | 115.2 p.s.i. |
| 130°F | 128.5 p.s.i. |
| 140°F | 140.9 p.s.i. |

In the test, the water bath was first held at 100°F and then raised successively to 120°F, at which point the test was completed. Three of the closures vented excess gas pressure in the 100°F bath. One closure vented excess pressure in the 120°F bath. In other words, from the above described calculations, three of the closures vented at approximately 91 p.s.i., while one closure vented at approximately 115 p.s.i.

The results of the tests are significant in that they show that, by employing a relieving bottle closure according to the invention, the side seal of the closure can be caused to fail positively in a low enough pressure range to avoid the possibility of explosion of a properly manufactured bottle.

A relieving bottle closure having the advantages of the above described embodiment can also be produced in other ways. For example, instead of the openings 18 in the skirt 11*a* of the assembled bottle closure 10*a* illustrated in FIG. 4, a standard bottle closure of the type shown in the above referenced Osborne et al patent could be employed, with a modification of the pressure block 24 described in connection with FIG. 4 above. To produce a venting area in the skirt 11*a* of the closure 10*a*, the pressure block 24 would include a cut out portion (not shown) adjacent the side finish 22 of the bottle 20. The cut out portion, which would be slightly larger in area than the opening 18 shown in the figures, would form a bulged-out portion of the closure skirt in the location where the opening 18 is shown in the figures. This would of course have the same pressure-relieving effect as the openings 18 shown.

Similarly, the closure could be formed conventionally, with the side finish of the bottle contoured so that instead of being a uniform cylindrical ring it would have depressions (not shown) in the side sealing surface.

Various other embodiments and alterations to this preferred embodiment will be apparent to those skilled in the art and may be made without departing from the spirit and scope of the following claims.

What is claimed is:

1. A pressure relieving bottle closure, comprising:

a top panel positioned above the top finish of a bottle;

a cylindrical side skirt connected to the top panel and positioned circumjacent a side finish below and adjacent the top finish of the bottle;

a resilient sealing liner interposed between the top panel of the closure and the top finish of the bottle and between the side skirt of the closure and the side finish of the bottle; and means for retaining the closure to the bottle with the sealing liner compressively engaged between said top panel and the top finish of the bottle and between said side skirt and a portion, but less than all of the side finish of the bottle;

said side skirt including at least one relieved area adjacent the uncompressed portion of the liner whereby, under sufficient internal bottle pressure, the portion of the sealing liner which is not compressed between said skirt and the side finish of the bottle is free to bulge outwardly at the location of the relieved area to pass pressurized fluid to relieve excess pressure in the bottle.

2. The pressure relieving closure of claim 1 wherein the relieved area of the side skirt is generally rectangular in shape with a length along the circumference of the side skirt of about 0.16 inch and a width of about 0.08 inch.

3. The pressure relieving closure of claim 1 wherein the relieved area of the side skirt has a length along the circumference of the side skirt of about 0.05 times the circumference of the side skirt.

4. The pressure relieving closure of claim 1 wherein the relieved area of the side skirt is generally rectangular with a height at least 80% of the height of the side sealing surface of the side finish of the bottle.

5. A pressure relieving bottle closure according to claim 1 in which said side skirt includes at least one opening defining said relieved area.

* * * * *